US012146388B1

(12) United States Patent
King

(10) Patent No.: US 12,146,388 B1
(45) Date of Patent: Nov. 19, 2024

(54) PUSH ON AND PULL OFF CONFIGURABLE RETRIEVING SYSTEM FOR INTERCEPT RETRIEVABLE BRIDGE PLUG

(71) Applicant: Halliburton Energy Services, Inc., Houston, TX (US)

(72) Inventor: Douglas King, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/310,392

(22) Filed: May 1, 2023

(51) Int. Cl.
*E21B 34/08* (2006.01)
*E21B 23/04* (2006.01)
*E21B 33/134* (2006.01)

(52) U.S. Cl.
CPC ..... *E21B 34/08* (2013.01); *E21B 23/042* (2020.05); *E21B 33/134* (2013.01)

(58) Field of Classification Search
CPC .... E21B 23/042; E21B 23/04; E21B 23/0411; E21B 23/0412; E21B 23/00; E21B 33/134
See application file for complete search history.

(56) References Cited

U.S. PATENT DOCUMENTS 4,007,783 A * 2/1977 Amancharla ..... E21B 23/06 166/135
4,869,325 A 9/1989 Halbardier
7,673,693 B2 3/2010 Standridge et al.
2015/0376957 A1 12/2015 Thomas
2018/0023358 A1 1/2018 Kozinsky et al.
2018/0328133 A1 11/2018 Massey
2019/0093447 A1 3/2019 Clemens et al.
2020/0232291 A1* 7/2020 Beach ..... E21B 23/12
(Continued)

FOREIGN PATENT DOCUMENTS

CN 113356786 A * 9/2021
CN 113356792 A * 9/2021
CN 115263249 A * 11/2022 ..... E21B 43/10
(Continued)

OTHER PUBLICATIONS

Halliburton, Intercept retrievable bridge plug, data sheet, H012195, Apr. 4, 2020.
(Continued)

*Primary Examiner* — George S Gray
(74) *Attorney, Agent, or Firm* — Scott Richardson; C. Tumey Law Group PLLC

(57) ABSTRACT

Systems and methods of the present disclosure relate to shifting downhole tools based on pressure. A downhole tool comprises an inner sleeve, an outer sleeve including: a chamber and a pressure relief valve in communication with the chamber. A return spring is disposed in the chamber. The outer sleeve is movable in forward and backward directions relative to the inner sleeve. A ball is disposed between the outer sleeve and the inner sleeve. A spacer is adjacent to the ball and a groove is adjacent to the spacer. A pocket is configured to receive the spacer upon movement of the outer sleeve in a forward direction. The spacer is configured to travel to the ball from the pocket and from the ball to the pocket. The pressure relief valve is configured to pass fluid based on a threshold pressure to unlock and move the outer sleeve in a backward direction.

16 Claims, 10 Drawing Sheets

(56) References Cited

U.S. PATENT DOCUMENTS

2021/0293107 A1 9/2021 Eitschberger

FOREIGN PATENT DOCUMENTS

| | | | |
|---|---|---|---|
| CN | 116006125 | | 4/2023 |
| WO | 2021113758 | A1 | 6/2021 |
| WO | 2022256454 | | 12/2022 |
| WO | WO-2022256454 | A1 * | 12/2022 |

OTHER PUBLICATIONS

International Search Report and Written Opinion for International Patent Application No. PCT/US2023/023196 dated Jan. 30, 2024.
European Patent Office Extended European Search Report for EPO Application No. 24154806.4 dated Aug. 1, 2024. PDF file. 5 pages.

* cited by examiner

PUSH ON AND PULL OFF CONFIGURABLE RETRIEVING SYSTEM FOR INTERCEPT RETRIEVABLE BRIDGE PLUG

BACKGROUND

During some oilfield retrieval operations, a mechanism that locks a retrieving tool to a bridge plug may become stuck in the open position. Current parts can decentralize causing the locking mechanism to become bound inside its dynamic bore even with a return spring to assist closure. Current systems may also include a complex geometry where engaging components interact, thereby increasing production costs.

BRIEF DESCRIPTION OF THE DRAWINGS

These drawings illustrate certain aspects of some examples of the present disclosure and should not be used to limit or define the disclosure.

DETAILED DESCRIPTION

The present disclosure relates to a downhole tool that utilizes pressure relief valves to configure the unlocking pressure. With all components being part of the same sub assembly, there is not a potential for decentralization. This should prevent the locking feature from becoming stuck open. Components are designed such that basic machining processes (e.g., lathe, mill) may be used to create the components, and not require electrical discharge machining (EDM), for example. The systems as described herein may be configured to unlock at multiple pressures allowing tandem bridge plugs to be set in a single down hole trip. The system utilizes pressure relief valves to configure the unlocking pressure for the retrieving tool. The configurable disconnecting pressures may be used for setting tandem bridge plugs.

The downhole tool includes an outer sleeve, an inner sleeve, a sealing cap and a top adapter. In an open/unlocked position, ball(s) designed to receive an axial load are prevented from moving down into pocket(s). For example, once the retrieving tool engages a plug (e.g., a bridge plug), a spacer (e.g., a rigid member) is displaced into a pocket. This allows the ball to move into a groove on a piston housing and simultaneously allows the outer sleeve to close.

Figure 1:
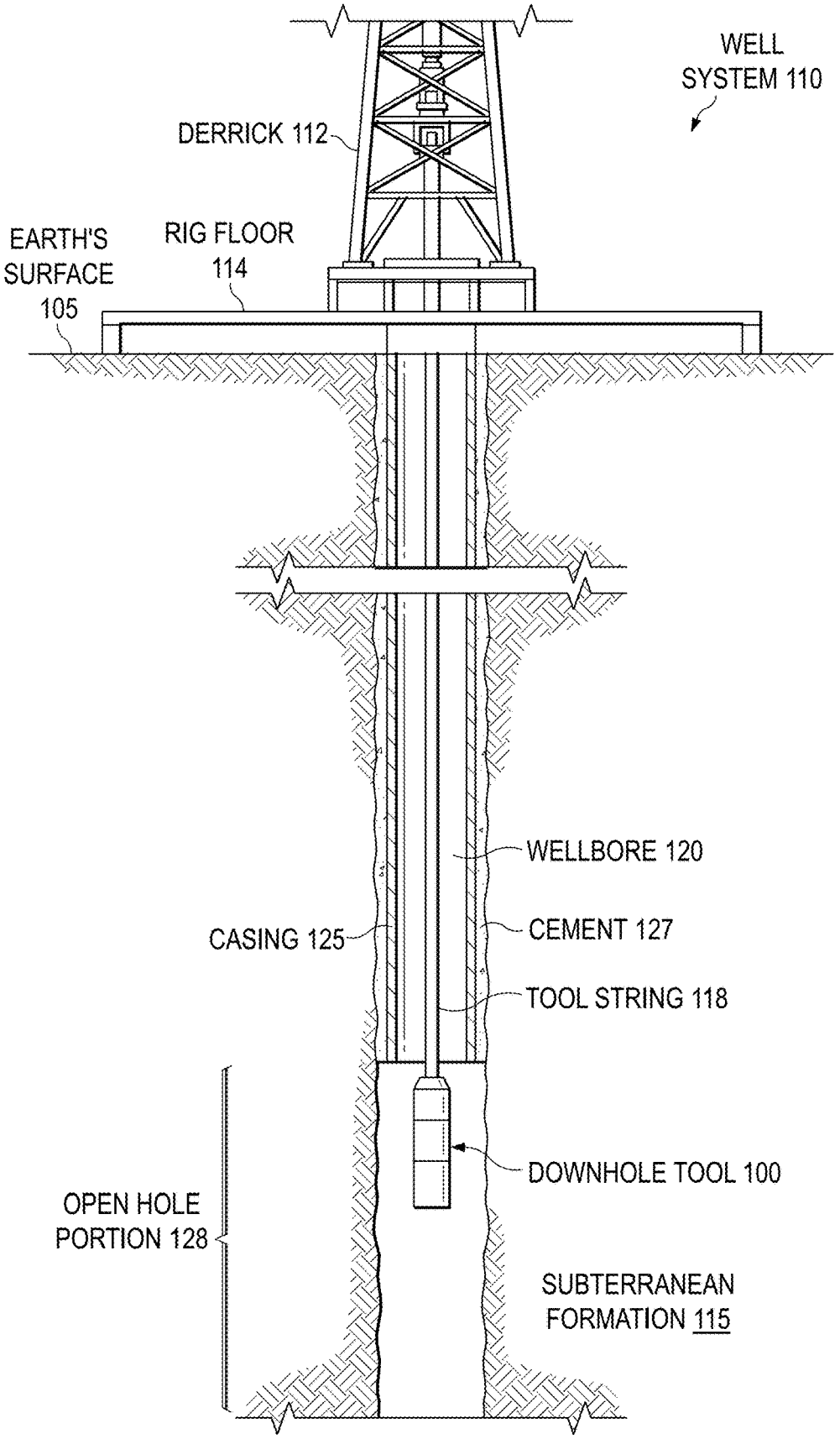
FIG. 1 illustrates an operating environment for a downhole tool, in accordance with examples of the present disclosure.

FIG. 1 illustrates a well system 110 (operating environment) for a downhole tool 100 (e.g., a retrieval tool), in accordance with examples of the present disclosure. In some examples, the downhole tool 100 may be used to retrieve or otherwise interact with plug 250 (e.g., a plug, tandem bridge plug) from a wellbore 120. A derrick 112 with a rig floor 114 is positioned on the earth's surface 105. A wellbore 120 is positioned below the derrick 112 and the rig floor 114 and extends into a subterranean formation 115. The wellbore 120 may be lined with casing 125 that is cemented in place with cement 127. Although FIG. 1 depicts the wellbore 120 having a casing 125 being cemented into place with cement 127, the wellbore 120 may include open hole portion 128. Moreover, the wellbore 120 may be an open-hole wellbore. The well system 110 may equally be employed in vertical and/or deviated wellbores.

A tool string 118 extends from the derrick 112 and the rig floor 114 downwardly into the wellbore 120. The tool string 118 may be any mechanical connection to the surface, such as, for example, jointed pipe, wireline, slickline, or coiled tubing. As depicted, the tool string 118 suspends the downhole tool 100 for placement into the wellbore 120 at a desired location to perform a specific downhole operation (e.g., locking onto plug 250).

Figure 2A:
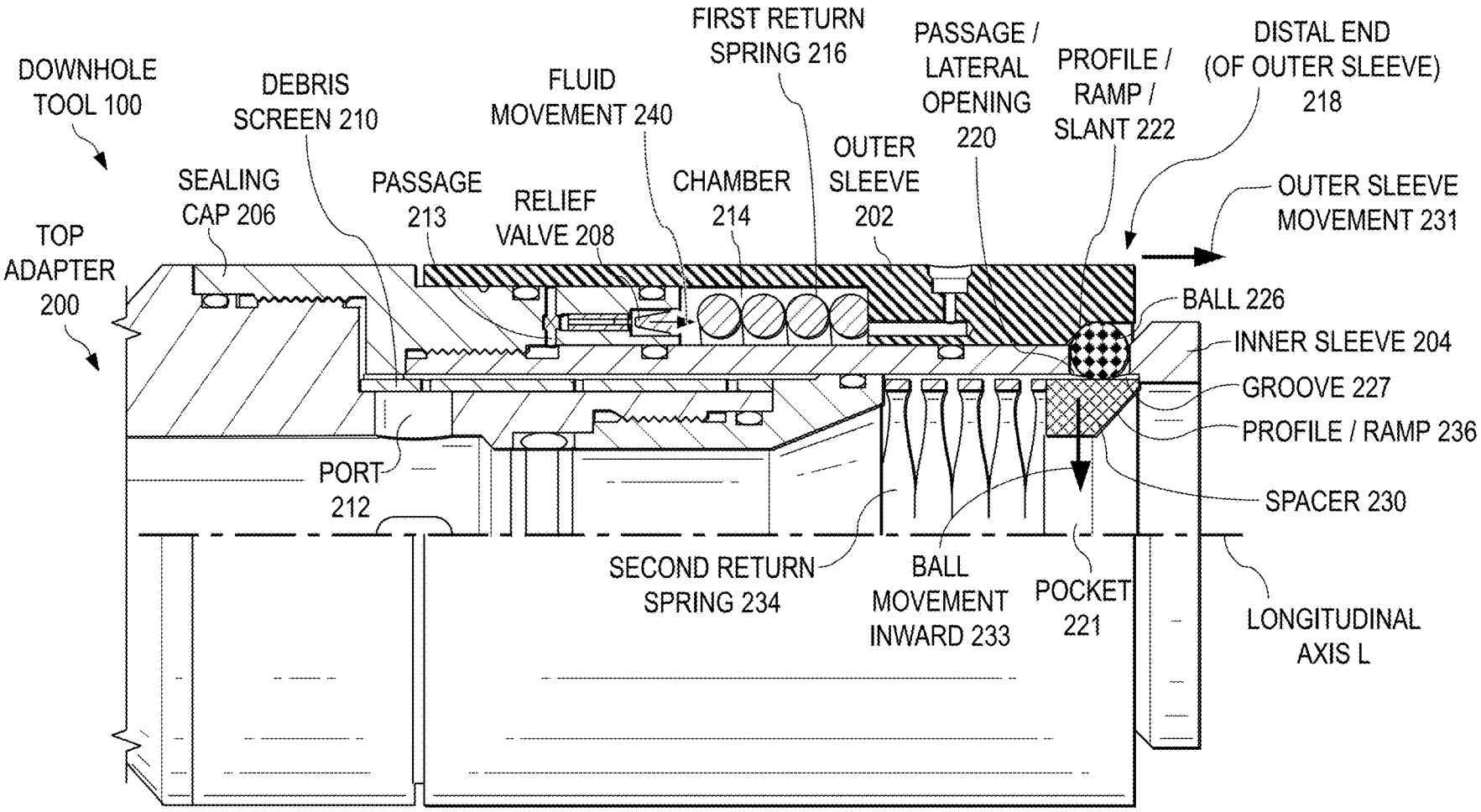
FIG. 2A illustrates the downhole tool in an open/unlocked configuration, in accordance with examples of the present disclosure.

FIG. 2A illustrates the downhole tool 100 in an open/unlocked configuration, in accordance with examples of the present disclosure. A top adapter 200 may be used to integrate the downhole tool 100 into a work string. The downhole tool 100 also includes an outer sleeve 202 that is disposed around an inner sleeve 204. The outer sleeve 202 is configured to move in axial directions along a longitudinal axis L of the downhole tool 100, relative to the inner sleeve 204. A sealing cap 206 (pressure cap) may be included in the outer sleeve 202. The sealing cap 206 may include a configurable pressure relief valve 208. The relief valve 208 may be configured to pass fluid at a desired/threshold pressure.

A debris screen 210 may be positioned between the outer sleeve 202 and the inner sleeve 204. The debris screen 210 filters wellbore fluid (e.g., mud, drilling fluid) as it passes through the debris screen 210 via a port 212 positioned in the inner sleeve 204. As the outer sleeve 202 is pushed forward, wellbore fluid passes through the tool string and the downhole tool 100. A portion of the fluid travels through the port 212 and through the debris screen 210. The fluid may then move through a passage 213 and through the relief valve 208 and into a chamber 214 contained in the outer sleeve 202. The chamber 214 may include a first return spring 216 to assist with movement of the outer sleeve 202. In the unlocked position, as shown, the first return spring 216 is compressed. The volume of the chamber 214 may increase as the outer sleeve 202 is moved forward.

A distal end of the inner sleeve 204 may include a passage 220 (e.g., lateral opening) that leads into a pocket 221. A profile 222 of the distal end 218 of the outer sleeve 202 may include a slant or ramp (e.g., facing inward) to guide a ball 226 inward/downward into a groove 227 of the inner sleeve 204. The groove 227 is adjacent to the passage 220. The ball 226 is positioned/secured against a member such as a spacer 230 and the outer sleeve 202 while in the passage 220 of the inner sleeve 204. The spacer 230 is configured to prevent pre-locking/undesired locking of the outer sleeve 202. As the outer sleeve 202 is moved forward (arrow 231), the ball 226 is forced inward.

The pocket 221 includes a second return spring 234 to apply a force against spacer 230. Consequently, the spacer 230 is held in a position blocking the passage 220 and thereby preventing the ball 226 from traversing therethrough. In the open/unlocked position, as shown in FIG. 2A, the second return spring 234 is expanded (uncompressed).

In the open/unlocked position, the outer sleeve 202 is under static load against the inner sleeve 204 due to the compression of the first return spring 216. However, the outer sleeve 202 is unable to translate (in a direction away from the top adapter 200) due to the ball 226 obstructing the path (and volume) into which the outer sleeve 202 would slide. Consequently, the ball 226 receives a static load from the outer sleeve 202 (contacting at the profile/ramp/slant 222) and is prevented from moving laterally inward (toward the longitudinal axis L) as the spacer 230 blocks any such movement. In turn, the spacer 230 is held in position via the second return spring 234 which exerts a longitudinal force against the spacer 230 (in a direction away from top adapter 200) to maintain position in front of the ball 226 (blocking passage 220). In the open/unlocked position, the ball 226 is positioned in the passage 220 between the outer sleeve 202, the inner sleeve 204, and the spacer 230 (as shown on FIG. 2A).

Figure 2B:
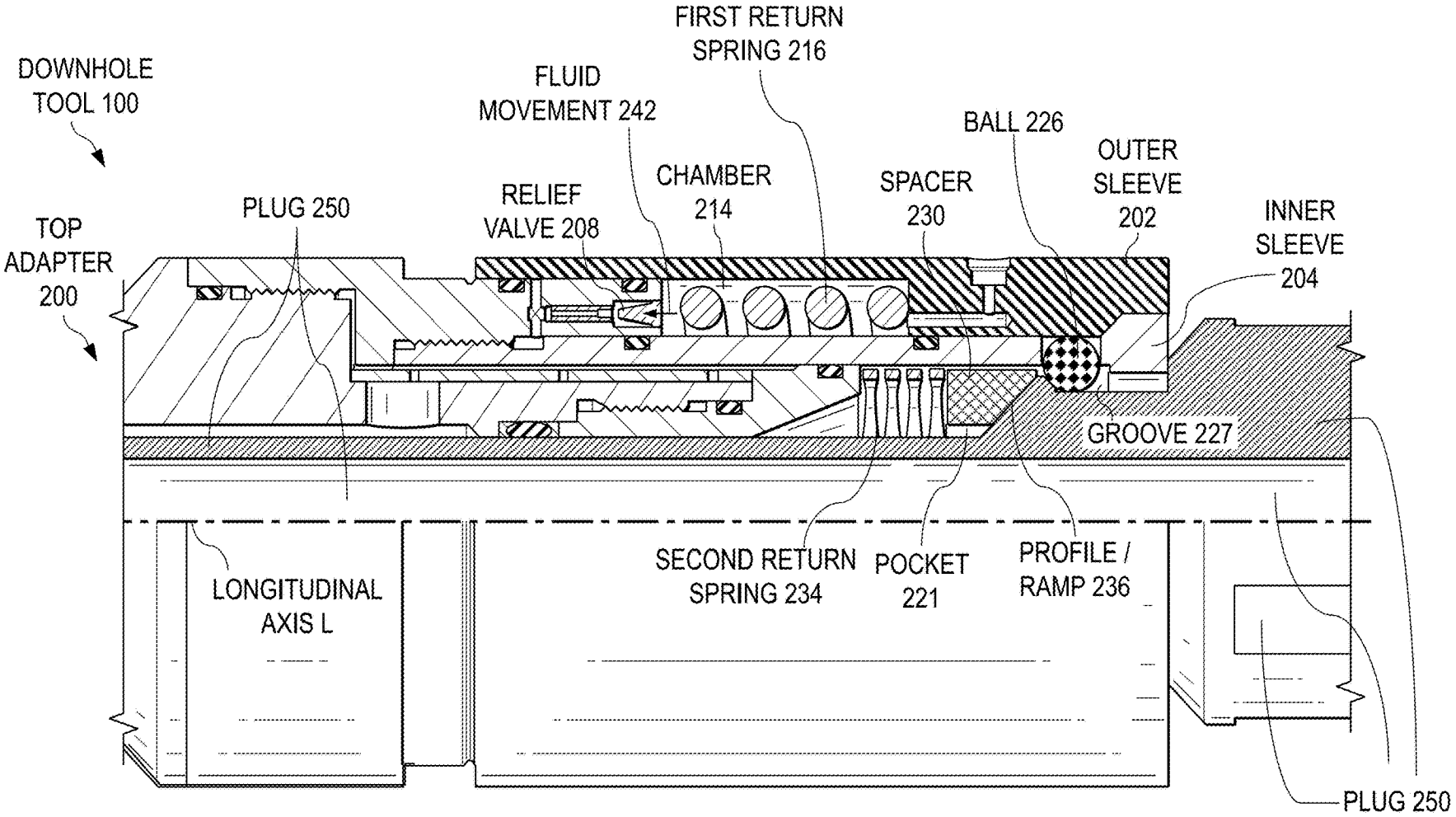
FIG. 2B illustrates the downhole tool in a closed/locked configuration, in accordance with examples of the present disclosure.

To move from the open/unlocked position (e.g., FIG. 2A) to a closed/locked position (e.g., FIG. 2B), the downhole tool 100 is lowered to a plug 250, where the downhole tool 100 surrounds a thinner elongated portion of the plug 250. From the downhole tool's 100 perspective, the plug 250 may slide into the inner sleeve 204 of the downhole tool 100 (even though the plug 250 may remain stationary). Upon insertion, the plug 250 comes into contact with the spacer 230 (specifically the profile/ramp 236 thereof). As the plug 250 continues to be inserted into the downhole tool 100, the plug 250 forces the spacer 230 to displace (towards the top adapter 200) causing the second return spring 234 to compress. As the spacer 230 is displaced, the passage 220 becomes unobstructed and the ball 226 is forced to move laterally inward (caused by the profile/ramp 222 of outer sleeve 202). In one or more embodiments, as the outer sleeve 202 is moved forward, fluid moves (directional arrow 240) through the relief valve 208 into the chamber 214. The ball 226 moves into the groove 227 of the inner sleeve 204 as the outer sleeve 202 moves forward and forces the ball 226 inward (arrow 233) due to the profile 222. The valve 208 is configured to open at a desired threshold fluid pressure. In the unlocked/open position, the first return spring 216 is compressed while the second return spring 234 is uncompressed. In the locked/closed position, the first return spring 216 is uncompressed while the second return spring 234 is compressed.

To unlock the downhole tool 100, the outer sleeve 202 is moved backward to the position shown on FIG. 2A. As the outer sleeve 202 is pulled back, fluid exits (arrow 242) the chamber 214 via the valve 208. The valve 208 is configurable and passes the fluid at a configured/desired pressure (threshold pressure). The first return spring 216 compresses to move the outer sleeve 202 backward and the second return spring 234 expands to move the spacer 230 back along the profile 236 to move the ball 226 back into the passage 220 to unlock the tool.

Figure 2C:
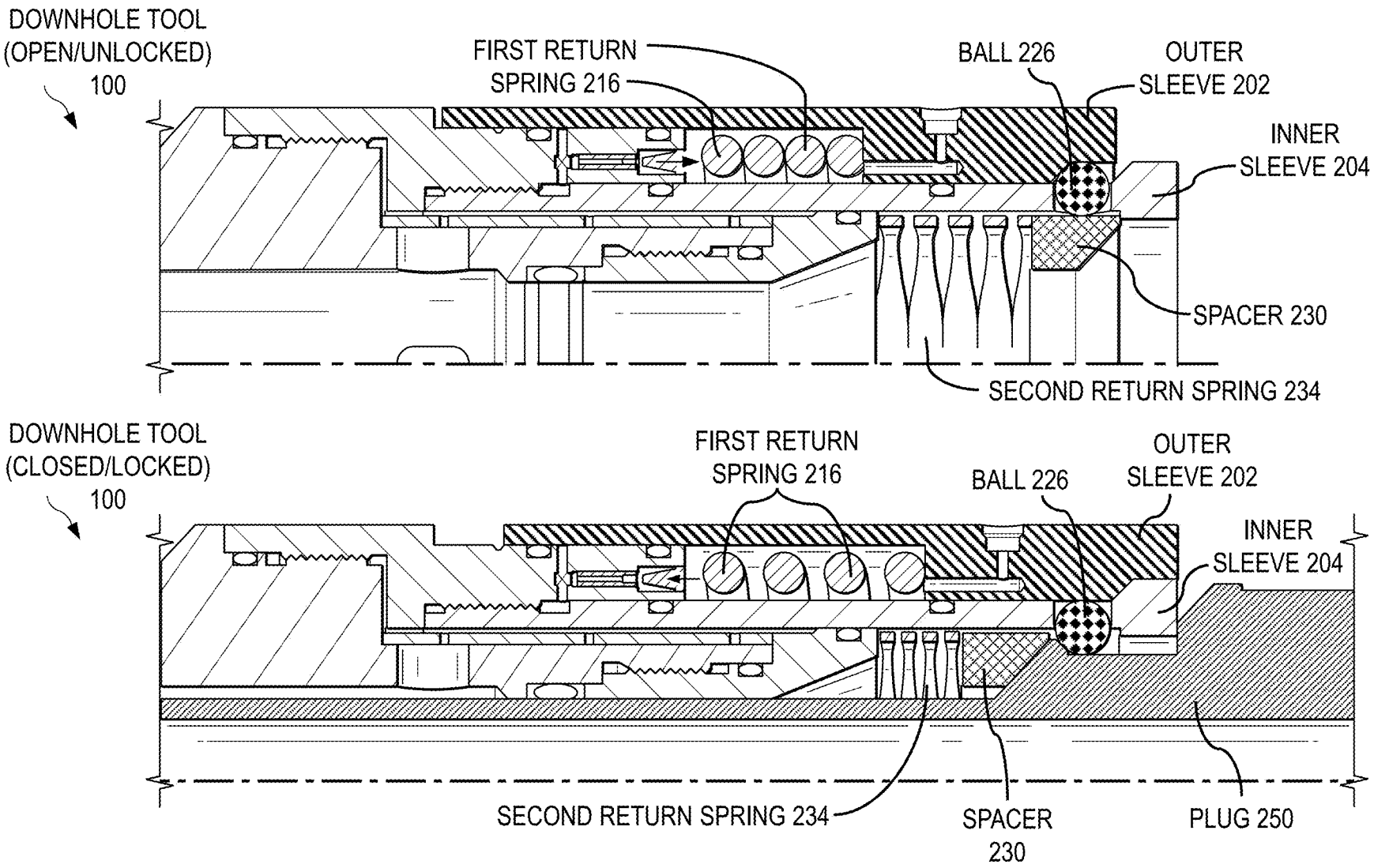
FIG. 2C illustrates a comparison between the open/unlocked and closed/locked of the downhole tool.

FIG. 2C shows a comparative view of the open/unlocked and closed/locked positions of the downhole tool 100. The top portion of FIG. 2C shows the downhole tool 100 in the open/unlocked position (like FIG. 2A) while the bottom portion of FIG. 2C shows the downhole tool 100 in the closed/locked position (like FIG. 2B). Only the cutaway portions of the downhole tool 100 are shown in FIG. 2C.

In FIG. 2C, the majority of the downhole tool 100 is aligned vertically across both embodiments shown in FIG. 2C, with only certain components changing position (e.g., the outer sleeve 202, the ball 226, the spacer 230, the first return spring 216, and the second return spring 234) and one component introduced (the plug 250). In one or more embodiments, FIG. 2C shows how certain components remain comparatively stationary (e.g., inner sleeve 204) with respect to other components (e.g., the outer sleeve 202, the ball 226, etc.).

Figure 3:
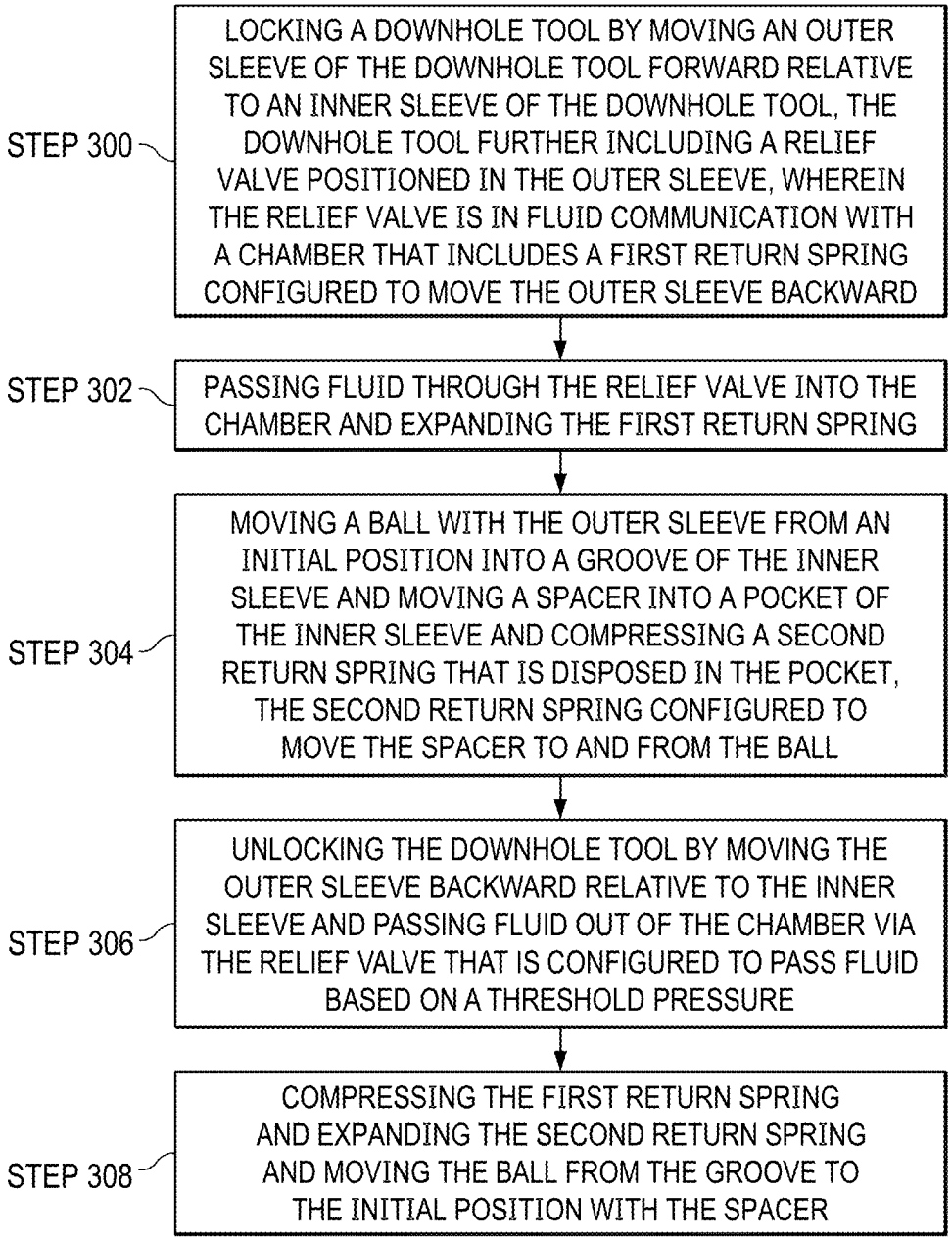
FIG. 3 illustrates an operative sequence for the downhole tool, in accordance with examples of the present disclosure.

FIG. 3 illustrates an operative sequence for locking and unlocking the downhole tool, in accordance with examples of the present disclosure. At step 300, a downhole tool is locked by moving an outer sleeve of the downhole tool forward relative to an inner sleeve of the tool. The tool further includes a relief valve positioned in the outer sleeve. The relief valve is in fluid communication with a chamber that includes a first return spring configured to move the outer sleeve backward. At step 302, fluid is passed through the relief valve into the chamber and the first return spring is expanded.

At step 304, a ball is moved with the outer sleeve from an initial position into a groove of the inner sleeve and a spacer is moved into a pocket of the inner sleeve and a second return spring that is disposed in the pocket is compressed. The second return spring is configured to move the spacer to and from the ball. The spacer is configured to move the ball back to the initial position. Locking steps 300, 302, and 304 may occur simultaneously.

At step 306, the downhole tool is unlocked by moving the outer sleeve backward relative to the inner sleeve and passing fluid from the chamber via the relief valve that is configured to pass fluid based on a threshold pressure. At step 308, the first return spring is compressed, and the second return spring is expanded, and the ball is moved with the spacer, from the groove to the initial position. Unlocking steps 306 and 308 may occur simultaneously.

Figure 4A:
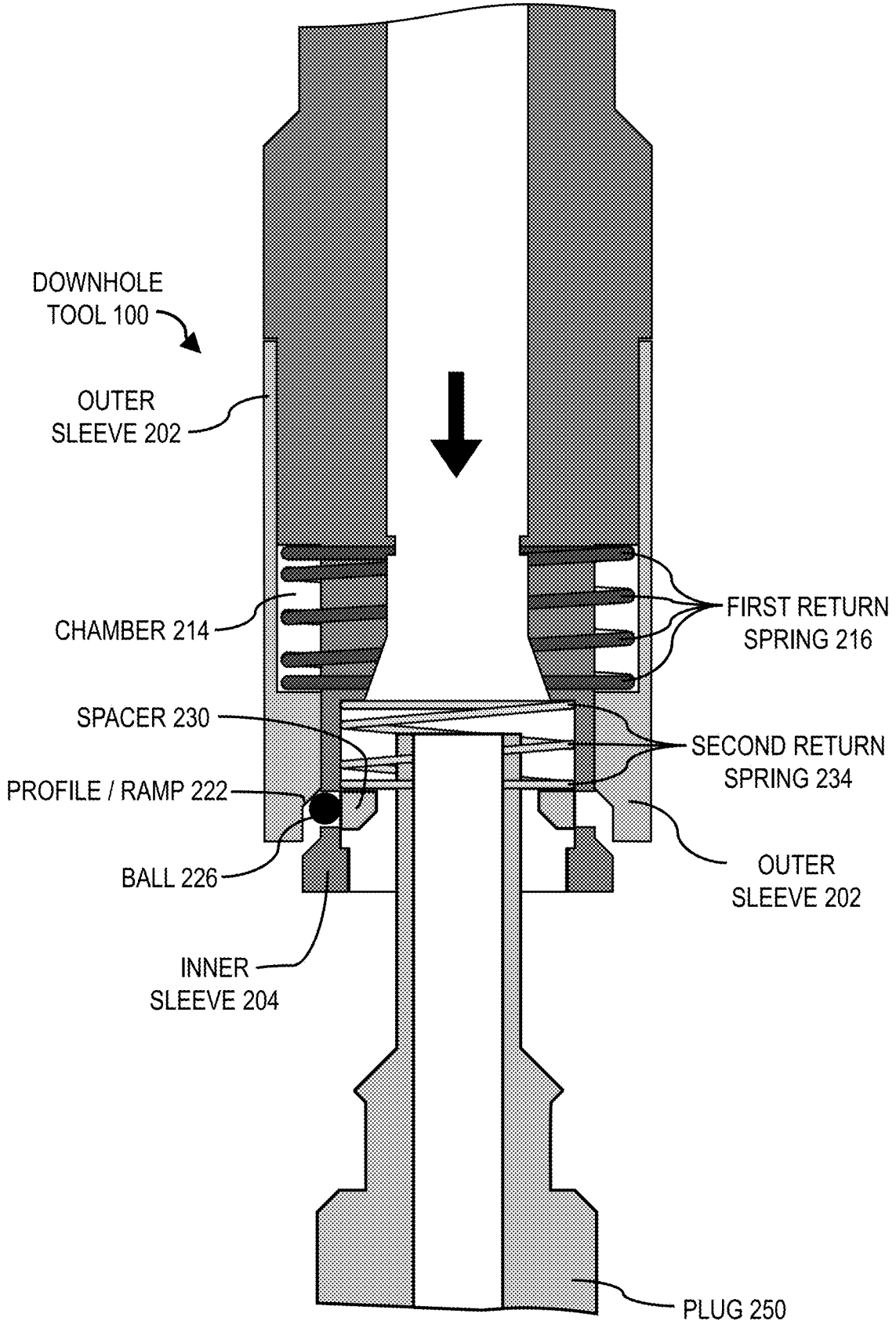
FIG. 4A illustrates a state of the downhole tool with an approaching plug.

FIGS. 4A-4E show various states of a downhole tool 100 and stages of interaction with a plug 250. As shown in FIG. 4A, the downhole tool 100 is in the open/unlocked position where the outer sleeve 202 is in the backward (retracted) position. The outer sleeve 202 is under tension to move forward (extend) as the first return spring 216 is under compression placing outward force against the outer sleeve 202 and the inner sleeve 204. However, the outer sleeve 202 is unable to extend forward as the ball 226 blocks (or otherwise prevents) the forward translation of the outer sleeve 202 (e.g., at the interface between the ball 226 and profile/ramp 222). In turn, the ball 226 cannot displace inward through the passage 220 (see FIGS. 2A-2C) as the spacer 230 prevents any such inward movement. Additionally, the spacer 230 maintains position blocking the passage 220 due to the placement of the second return spring 234. Further, in FIG. 4A, the downhole tool 100 is shown approaching and beginning to surround the plug 250.

Figure 4B:
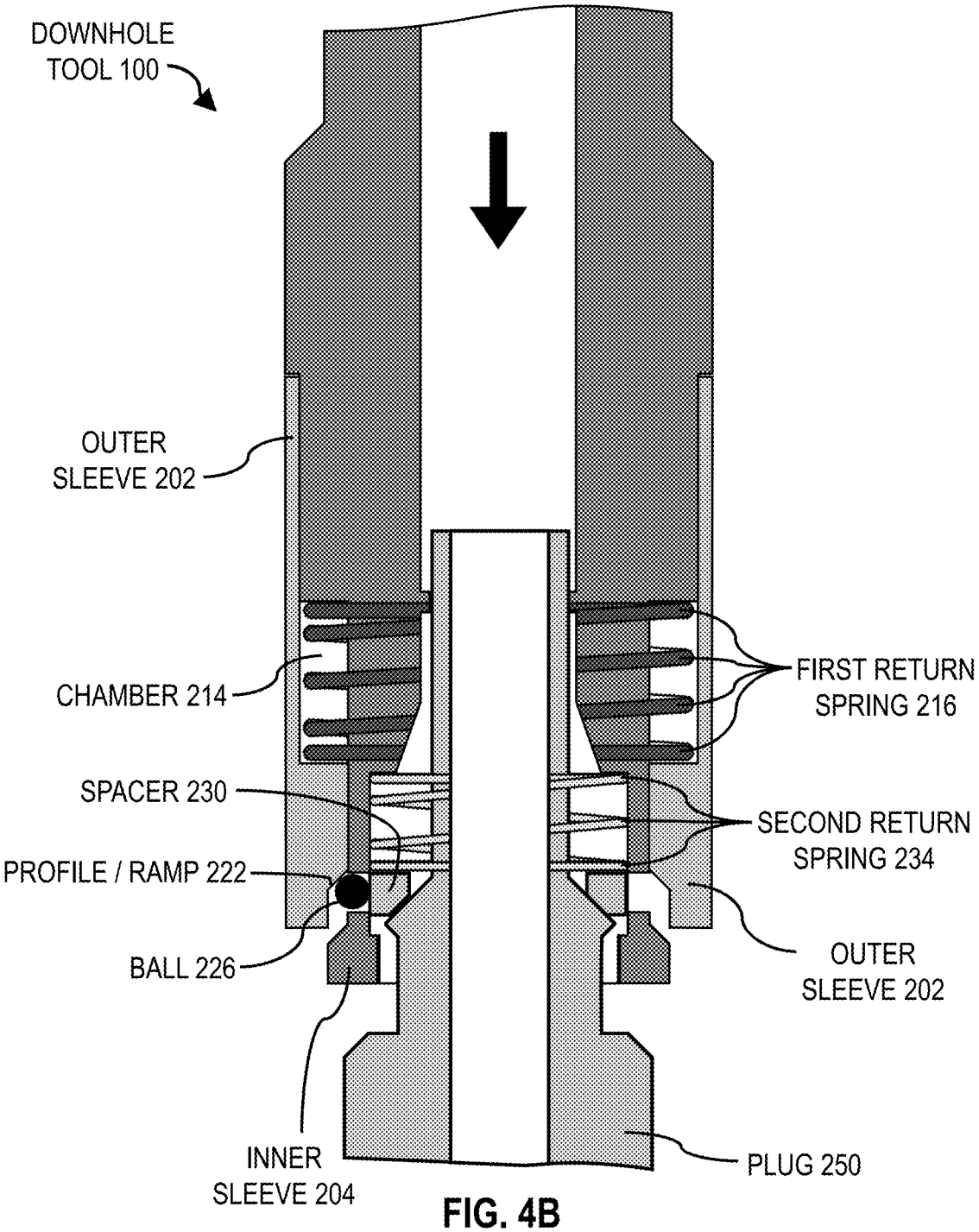
FIG. 4B illustrates a state of the downhole tool where a plug makes contact with a spacer.
Figure 4C:
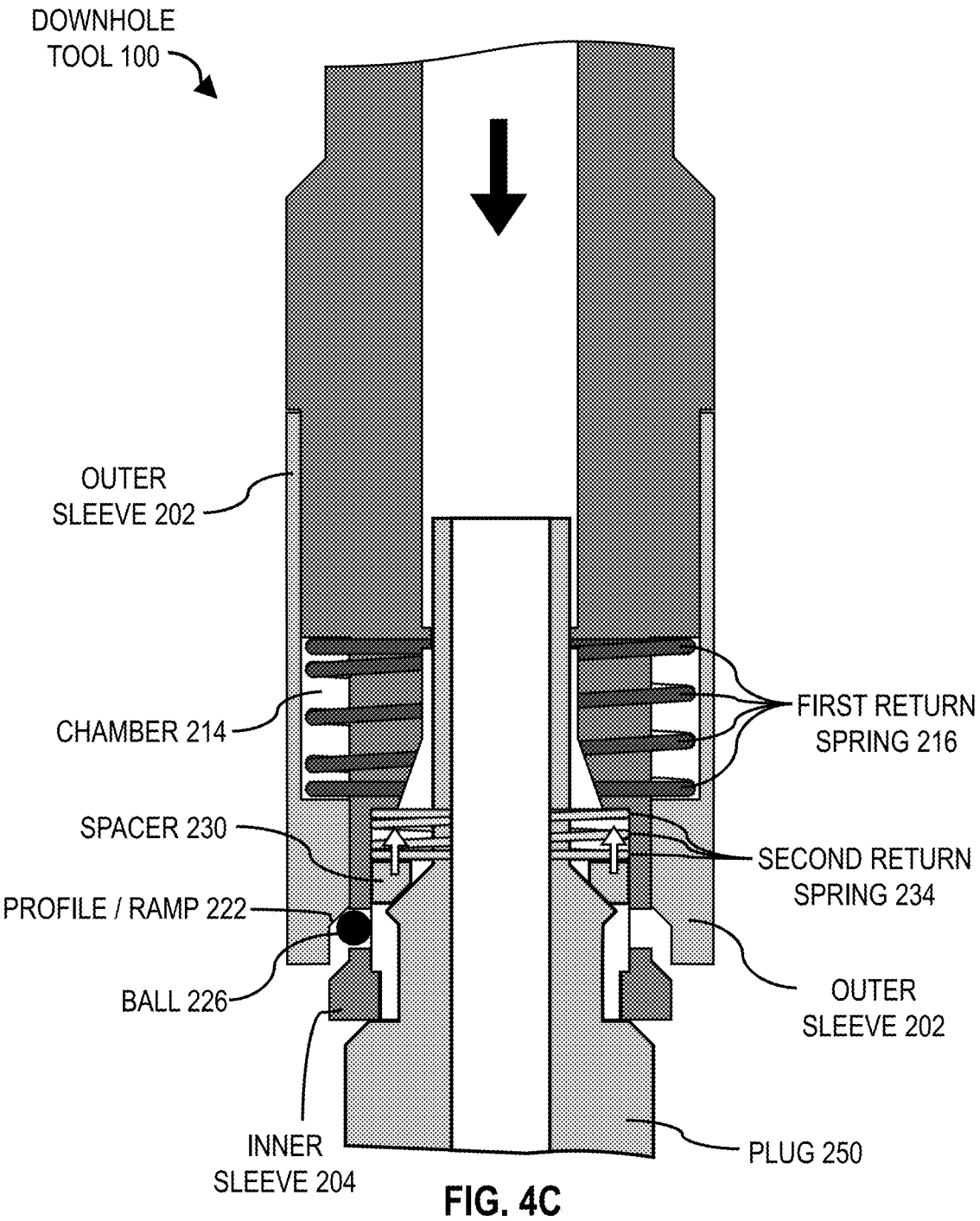
FIG. 4C illustrates a state of the downhole tool where a plug displaces the spacer.
Figure 4D:
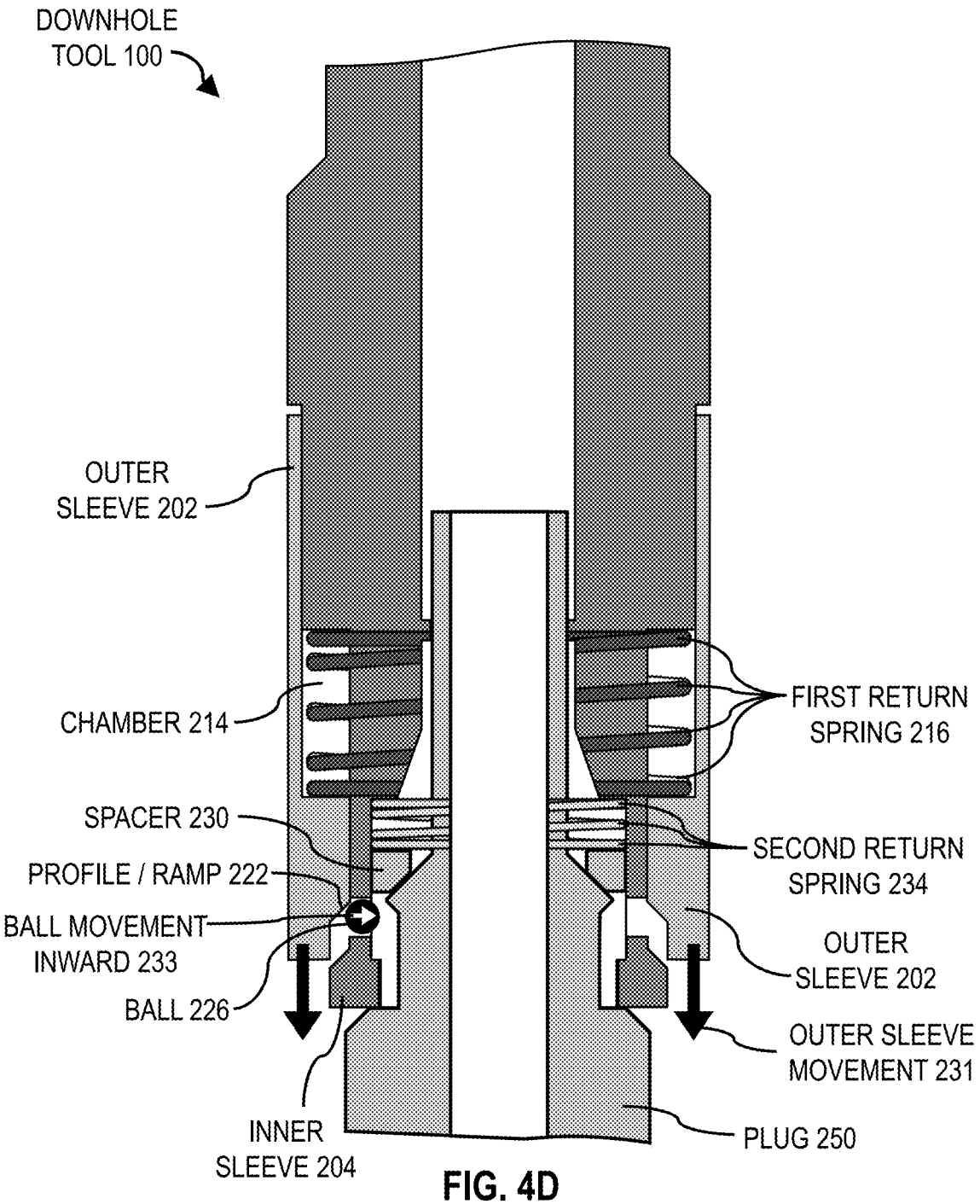
FIG. 4D illustrates a state of the downhole tool where the outer sleeve begins to shift.

In FIG. 4B, the downhole tool 100 continues to translate toward and surround the plug 250, until the outer contours of the plug 250 mate (or otherwise contact) the profile/ramp 236 of the spacer 230 of the downhole tool 100. In FIG. 4D, as the plug 250 continues to insert into the downhole tool 100, the plug 250 displaces the spacer 230 causing the second return spring 234 to compress. As the spacer 230 is shifted away from the passage/lateral opening 220, the ball 226 is no longer prevented from moving inward toward the plug 250.

Figure 4E:
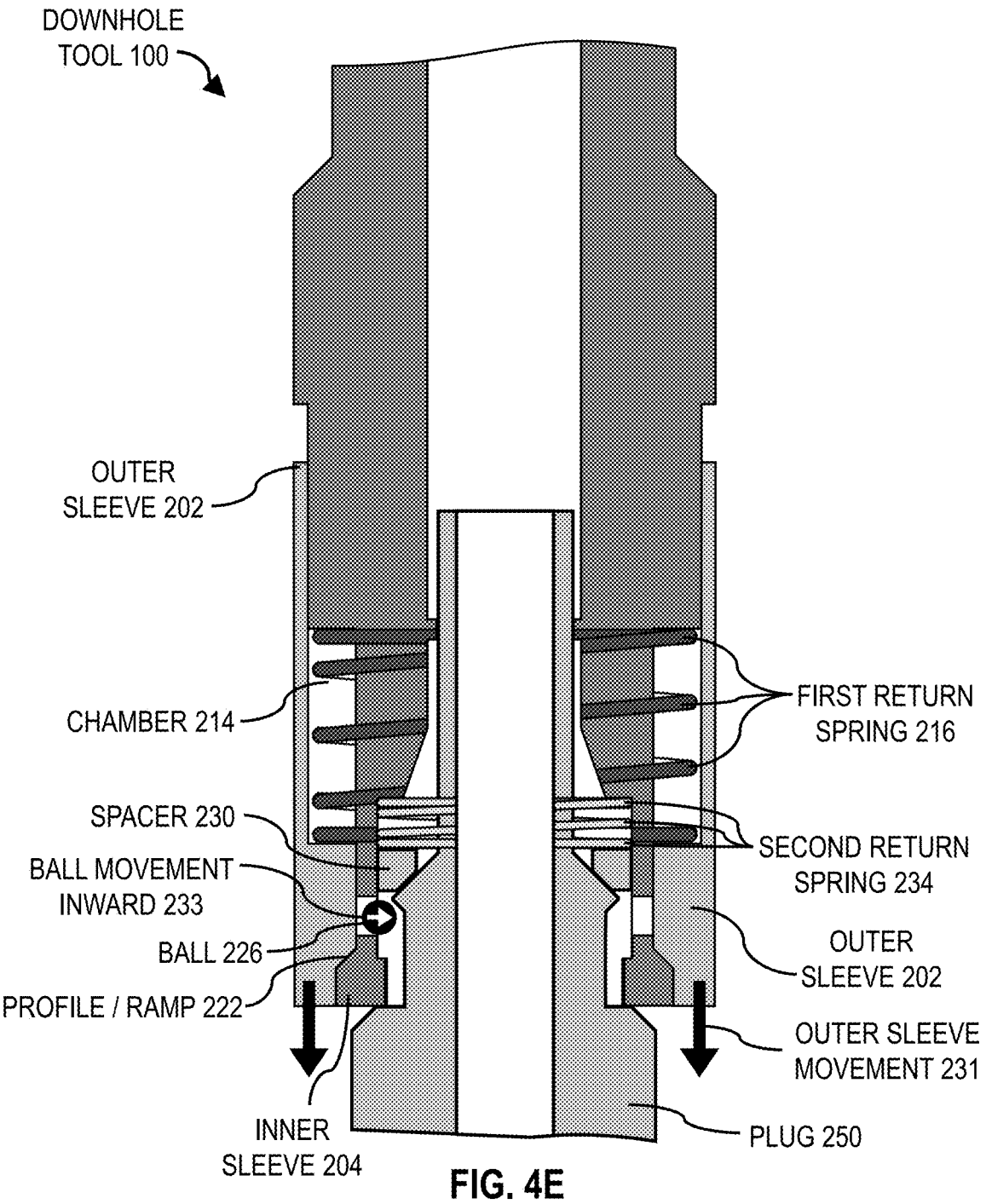
FIG. 4E illustrates a state of the downhole tool where the ball moves inward, and the outer sleeve is fully displaced.

In FIG. 4D, the outer sleeve 202 is able to begin undergoing outer sleeve movement 231. Specifically, as the passage 220 is not obstructed (e.g., by the spacer 230), the profile/ramp 222 of the outer sleeve 202 pushes the ball 226 inward. In FIG. 4D, the ball is caused to undergo ball movement inward 233 due to the force applied by the profile/ramp 222 of the outer sleeve 202. Consequently, as the ball 226 moves, the outer sleeve 202 is no longer obstructed and therefore slides forward (extends) due to the forces applied by the first return spring 216. At this stage, as shown in FIG. 4E, the downhole tool 100 is in the closed/locked position, where the first return spring 216 is uncompressed and the second return spring 234 is compressed.

Accordingly, the systems and methods of the present disclosure use a downhole tool that utilizes pressure relief valves to configure the unlocking pressure. The systems and methods may include any of the various features disclosed herein, including one or more of the following statements.

Statement 1. A downhole tool comprising: an inner sleeve; an outer sleeve including: a chamber and a pressure relief valve in communication with the chamber, wherein a first return spring is disposed in the chamber, wherein the outer sleeve is movable in forward and backward directions relative to the inner sleeve; a ball disposed between the outer sleeve and the inner sleeve; a spacer adjacent to the ball; a groove adjacent to the spacer, the groove configured to receive the ball upon movement of the outer sleeve in the forward direction; and a pocket configured to receive the spacer upon movement of the outer sleeve in the forward direction, the pocket including a second return spring, the spacer configured to travel to the ball from the pocket and from the ball to the pocket, wherein the pressure relief valve is configured to pass fluid based on a threshold pressure to unlock and move the outer sleeve in the backward direction.

Statement 2. The downhole tool of the statement 1, wherein the pocket includes a profile configured to guide the spacer upon movement of the outer sleeve.

Statement 3. The downhole tool of the statement 1 or the statement 2, wherein the profile includes a ramp.

Statement 4. The downhole tool of any one of the statements 1-3, wherein the first return spring is expanded, and the outer sleeve is in a forward position.

Statement 5. The downhole tool of any one of the statements 1-4, wherein the second return spring is compressed, and the outer sleeve is in the forward position.

Statement 6. The downhole tool of any one of the statements 1-5, further comprising a filter configured to filter fluid passing into the chamber.

Statement 7. The downhole tool of any one of the statements 1-6, wherein the outer sleeve includes a profile to move the ball inward into the groove.

Statement 8. The downhole tool of any one of the statements 1-7, wherein the profile includes a ramp.

Statement 9. The downhole tool of any one of the statements 1-8, wherein the fluid includes a drilling fluid.

Statement 10. The downhole tool of any one of the statements 1-9, wherein the first return spring is compressed, and the outer sleeve is not in the forward position.

Statement 11. The downhole tool of any one of the statements 1-10, wherein the second return spring is expanded, and the outer sleeve is not in the forward position.

Statement 12. A method comprising: unlocking a downhole tool by moving an outer sleeve backward relative to an inner sleeve and passing fluid from a chamber via a pressure relief valve that is configured to pass fluid based on a threshold pressure, the downhole tool including: an inner sleeve; the outer sleeve including: the chamber and the pressure relief valve, wherein a first return spring is disposed in the chamber, wherein the outer sleeve is movable in forward and backward directions relative to the inner sleeve; a ball disposed between the outer sleeve and the inner sleeve; a spacer adjacent to the ball; a groove adjacent to the spacer, the groove configured to receive the ball upon movement of the outer sleeve in the forward direction; and a pocket configured to receive the spacer upon movement of the outer sleeve in the forward direction, the pocket including a second return spring, the spacer configured to travel to the ball from the pocket, and from the ball to the pocket.

Statement 13. The method of the statement 12, wherein the unlocking further comprises moving the ball from the groove of the inner sleeve and moving the spacer from the pocket of the inner sleeve and expanding the second return spring to move the spacer from the pocket to the ball.

Statement 14. The method of any one of the statements 12 or 13, further comprising locking the downhole tool by moving the outer sleeve of the downhole tool forward relative to the inner sleeve of the tool.

Statement 15. The method of any one of the statements 12-14, wherein the locking further comprises passing fluid through the relief valve into the chamber and expanding the first return spring.

Statement 16. The method of any one of the statements 12-15, wherein the locking further comprises moving the ball with the outer sleeve into the groove of the inner sleeve and moving the spacer into the pocket and compressing the second return spring with the spacer.

Statement 17. The method of any one of the statements 12-16, wherein the locking further comprises expanding the first return spring.

Statement 18. The method of any one of the statements 12-17, wherein the pocket includes a profile configured to guide the spacer upon movement of the outer sleeve.

Statement 19. The method of any one of the statements 12-18, wherein the profile includes a ramp.

Statement 20. The method of any one of the statements 12-19, wherein the outer sleeve includes a profile to move the ball inward into the groove.

Although the present disclosure and its advantages have been described in detail, it should be understood that various changes, substitutions, and alterations may be made herein without departing from the spirit and scope of the disclosure as defined by the appended claims. The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the elements that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:
an inner sleeve;
an outer sleeve including:
a chamber and a pressure relief valve in communication with the chamber, wherein a first return spring is disposed in the chamber, wherein the outer sleeve is movable to a forward position and to a backward position relative to the inner sleeve;
a ball disposed between the outer sleeve and the inner sleeve;
a spacer adjacent to the ball;
a groove adjacent to the spacer, the groove configured to receive the ball upon movement of the outer sleeve to the forward position; and
a pocket configured to receive the spacer upon movement of the outer sleeve to the forward position, the pocket including a second return spring,
wherein the spacer is configured to travel axially along a longitudinal axis of the downhole tool during compression of the second return spring,
wherein the pressure relief valve is configured with an unlocking pressure to allow for movement of the outer sleeve to the backward position to unlock the downhole tool.

2. The downhole tool of claim 1, wherein the pocket includes a profile configured to guide the spacer upon movement of the outer sleeve.

3. The downhole tool of claim 2, wherein the profile includes a ramp.

4. The downhole tool of claim 3, wherein the second return spring is compressed, and the outer sleeve is in the forward position.

5. The downhole tool of claim 1, wherein the first return spring is expanded, and the outer sleeve is in the forward position.

6. The downhole tool of claim 1, wherein the outer sleeve includes a profile to move the ball inward into the groove.

7. The downhole tool of claim 6, wherein the profile includes a ramp.

8. The downhole tool of claim 1, wherein the first return spring is compressed, and the outer sleeve is not in the forward position.

9. The downhole tool of claim 1, wherein the second return spring is expanded, and the outer sleeve is not in the forward position.

10. A method comprising:
locking a downhole tool by moving an outer sleeve in a forward position relative to an inner sleeve, the downhole tool including:
the inner sleeve;
the outer sleeve including:
a chamber and a pressure relief valve, wherein a first return spring is disposed in the chamber, wherein the outer sleeve is movable to the forward position and to a backward position relative to the inner sleeve;
a ball disposed between the outer sleeve and the inner sleeve;
a spacer adjacent to the ball;
a groove adjacent to the spacer, the groove configured to receive the ball upon movement of the outer sleeve to the forward position; and
a pocket configured to receive the spacer upon movement of the outer sleeve to the forward position, the pocket including a second return spring,
wherein the spacer is configured to travel axially along a longitudinal axis of the downhole tool during compression of the second return spring.

11. The method of claim 10, wherein the locking further comprises moving the ball to the groove of the inner sleeve, moving the spacer, and compressing the second return spring.

12. The method of claim 10, wherein the locking further comprises moving the ball with the outer sleeve into the groove of the inner sleeve and moving the spacer into the pocket and compressing the second return spring with the spacer.

13. The method of claim 12, wherein the locking further comprises expanding the first return spring.

14. The method of claim 10, wherein the pocket includes a profile configured to guide the spacer upon movement of the outer sleeve.

15. The method of claim 14, wherein the profile includes a ramp.

16. The method of claim 10, wherein the outer sleeve includes a profile to move the ball inward into the groove.

* * * * *